US009840886B1

(12) United States Patent
Gable et al.

(10) Patent No.: US 9,840,886 B1
(45) Date of Patent: Dec. 12, 2017

(54) ROBOTIC MANIPULATORS FOR SUBSEA, TOPSIDE, AND ONSHORE OPERATIONS

(71) Applicant: OneSubsea IP UK Limited, London (GB)

(72) Inventors: Brent David Gable, Cypress, TX (US); Andrea Paulina Rubio, Houston, TX (US); Diana Kathryn Grauer, Cypress, TX (US)

(73) Assignee: ONESUBSEA IP UK LIMITED, London (GB)

( * ) Notice: Subject to any disclaimer, the term of this patent is extended or adjusted under 35 U.S.C. 154(b) by 0 days.

(21) Appl. No.: 15/190,172

(22) Filed: Jun. 22, 2016

(51) Int. Cl.
*E21B 33/035* (2006.01)
*E21B 41/04* (2006.01)
*E21B 33/076* (2006.01)

(52) U.S. Cl.
CPC ..... *E21B 33/076* (2013.01)

(58) Field of Classification Search
CPC ..... E21B 33/076; E21B 41/04; B25J 9/06
See application file for complete search history.

(56) References Cited

U.S. PATENT DOCUMENTS 3,099,316 A * 7/1963 Johnson ..... E21B 7/12 137/236.1
3,698,197 A * 10/1972 Bodey ..... B63C 11/42 104/71
3,854,296 A * 12/1974 Pogonowski ..... B63C 11/36 166/356
3,954,610 A * 5/1976 Pogonowski ..... B63C 11/36 210/170.11
4,643,616 A * 2/1987 Castel ..... E21B 41/04 166/338
4,860,681 A * 8/1989 Svenning ..... E21B 41/04 114/258
4,974,996 A * 12/1990 Vielmo ..... B25J 5/00 166/341
5,097,780 A * 3/1992 Winchester ..... B63G 8/001 114/330
6,167,831 B1 * 1/2001 Watt ..... B63G 8/001 114/245
6,223,675 B1 * 5/2001 Watt ..... B63G 8/001 114/312

(Continued)

FOREIGN PATENT DOCUMENTS

BR WO 2016000057 A1 * 1/2016 ..... E21B 41/04
CN 104712270 A * 6/2015

(Continued)

OTHER PUBLICATIONS

Mair, "MAC Manifold—A Revolutionary Concept in Deepwater Production," Underwater Technology International: Remote Intervention, Apr. 8-10, 1997, pp. 119-134, Society of Underwater Technology.

*Primary Examiner* — Matthew R Buck
(74) *Attorney, Agent, or Firm* — Eubanks PLLC

(57) ABSTRACT

An apparatus including a robotic manipulator coupled to an oilfield device to facilitate support operations. The robotic manipulator can include a tool for interacting with components of the oilfield device, and the robotic manipulator can provide three translational degrees of freedom of the tool with respect to the oilfield device. Additional systems, devices, and methods are also disclosed.

17 Claims, 9 Drawing Sheets

(56) References Cited

U.S. PATENT DOCUMENTS

| | | | | |
|---|---|---|---|---|
| 7,621,059 | B2 * | 11/2009 | McCoy, Jr. | E02F 3/905 114/296 |
| 8,250,901 | B2 | 8/2012 | Davis et al. | |
| 8,442,684 | B2 | 5/2013 | Davis et al. | |
| 8,443,693 | B2 | 5/2013 | Ihrke et al. | |
| 8,459,196 | B2 * | 6/2013 | Provencher | B23C 3/00 114/222 |
| 8,483,877 | B2 | 7/2013 | Abdallah et al. | |
| 8,627,740 | B2 * | 1/2014 | Skourup | B25J 19/0075 74/490.01 |
| 8,900,106 | B2 * | 12/2014 | McCoy, Jr. | B23Q 3/155 483/16 |
| 9,322,220 | B2 * | 4/2016 | Innes | E21B 7/124 |
| 2009/0114140 | A1 * | 5/2009 | Guerrero | B63G 8/001 114/321 |
| 2013/0011234 | A1 * | 1/2013 | Pretlove | B25J 5/005 414/749.1 |
| 2014/0060847 | A1 * | 3/2014 | Sunde | B63C 11/52 166/335 |
| 2014/0318666 | A1 * | 10/2014 | Benedetti | B65B 3/04 141/1 |
| 2016/0084633 | A1 * | 3/2016 | Ferrari | G01B 21/04 33/503 |
| 2016/0186534 | A1 * | 6/2016 | Schilling | B63C 11/52 166/351 |
| 2017/0159410 | A1 * | 6/2017 | Ceccon De Azevedo | E21B 41/0007 |

FOREIGN PATENT DOCUMENTS

| | | | | |
|---|---|---|---|---|
| JP | 06031670 | A | * | 2/1994 |
| KR | 20140135374 | A | * | 11/2014 |
| KR | 101487299 | B1 | * | 1/2015 |

* cited by examiner

ROBOTIC MANIPULATORS FOR SUBSEA, TOPSIDE, AND ONSHORE OPERATIONS

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource.

Offshore systems can include topside devices positioned above the surface of the water, such as on a vessel or platform, and subsea devices positioned underwater, such as on the seabed. Whether located subsea, topside, or onshore, devices used in drilling and production systems can themselves include many components to be actuated, installed, or retrieved to facilitate drilling or production. In topside and onshore contexts, operators may manually perform such support operations. In subsea contexts, a working vessel can be positioned above a subsea installation and a remotely operated vehicle (ROV) can be launched to travel to the subsea installation to perform support operations for the subsea devices.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

At least some embodiments of the present disclosure generally relate to robotic manipulators for facilitating support operations for an oilfield device. The robotic manipulators can include robotic arms with various degrees of freedom that allow the arms to perform a wide array of support functions. The robotic manipulators can be used with subsea, topside, and onshore devices, such as manifolds, trees, pumps, and blowout preventers. In some instances, a robotic manipulator includes a head adapted to receive any of multiple, interchangeable end effectors to increase the versatility of the robotic manipulator and enable a wider range of support operations. When not installed on the robotic manipulator, the multiple end effectors can be held in a tool box accessible to the robotic manipulator to enable efficient retooling of the robotic manipulator by simply switching end effectors.

Various refinements of the features noted above may exist in relation to various aspects of the present embodiments. Further features may also be incorporated in these various aspects. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
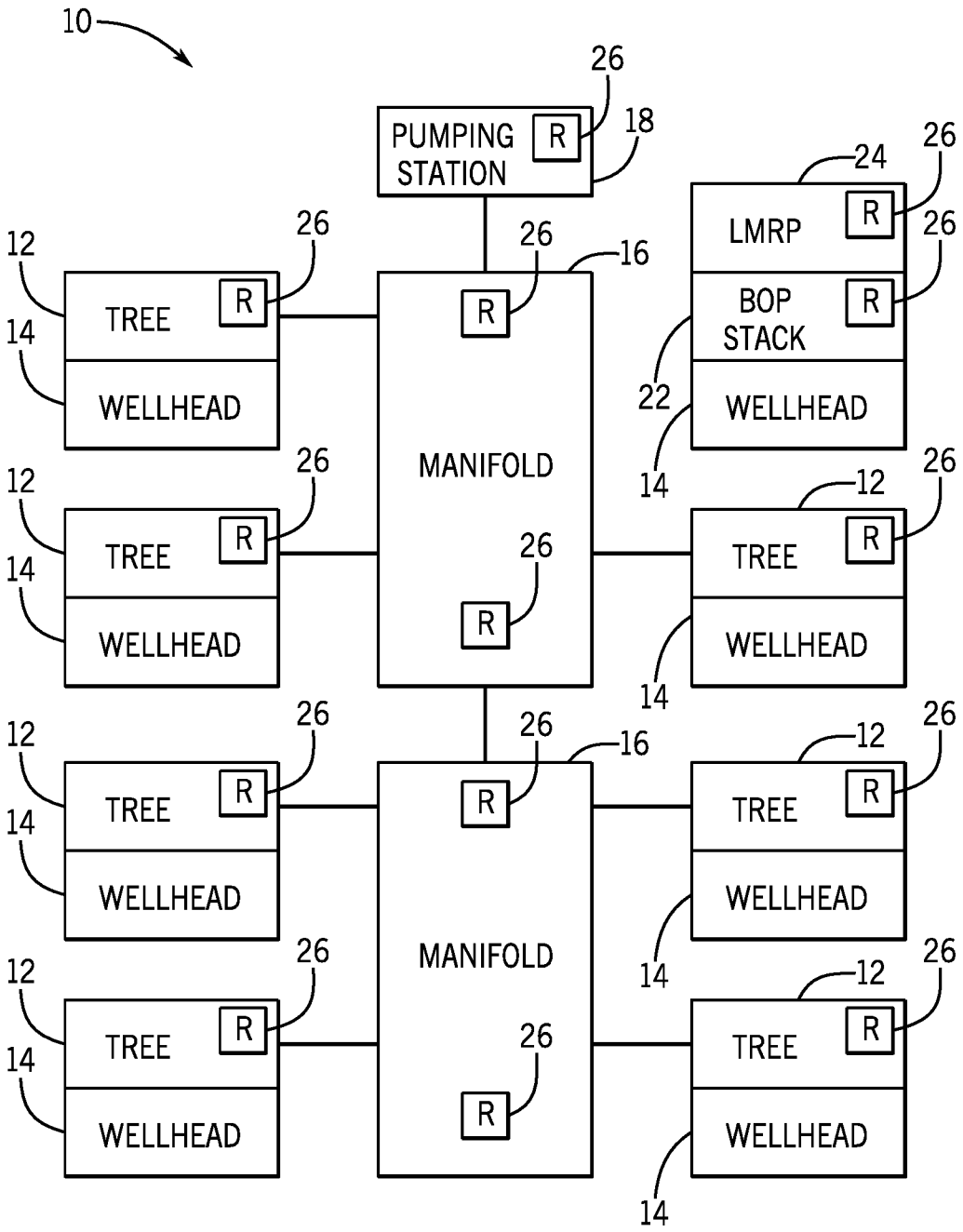
FIG. 1 generally depicts a production system having devices with robotic manipulators in accordance with one embodiment.

Turning now to the present figures, an apparatus 10 is illustrated in FIG. 1 in accordance with one embodiment. The depicted apparatus 10 is a production system that facilitates extraction of a resource, such as oil or natural gas, from a subterranean reservoir. The apparatus 10 is generally shown in FIG. 1 as a subsea production system having trees 12 (e.g., production or injection trees) coupled to wellheads 14 on a seabed. The wellheads 14 can include various components, such as casing heads, tubing heads, spools, and hangers, and the trees 12 can include valves for controlling fluid flow into and out of wells through the wellheads 14.

Reservoir fluid can be produced from the reservoir through the wellheads 14 and the trees 12, which are connected (e.g., via jumpers) to subsea manifolds 16 installed on the seabed. The manifolds 16 include valves to control flow of produced hydrocarbons or other fluids from the trees 12 through the manifolds 16. The produced fluid can also be routed from the manifolds 16 to processing equipment. For example, produced fluid may be routed to a pump (or pumping station) 18 for adding energy to the produced fluid to facilitate delivery of the fluid through various flowlines or risers to some other location, such as a production platform, a floating production storage and offloading (FPSO) vessel, or an onshore processing facility.

Wells can be drilled into the seabed with a drilling rig, such as a drillship or semi-submersible, positioned above the seabed. In at least some instances, the drilling rig will be coupled to a blowout preventer stack 22 mounted on a wellhead 14 via a riser and a lower marine riser package 24. As will be appreciated by those skilled in the art, the blowout preventer stack 22 can include ram-type and annular preventers, and the lower marine riser package 24 can include various control components for operating the preventers of the blowout preventer stack 22. Additionally, the lower marine riser package 24 may itself include one or more preventers, such as an annular preventer.

A rotating drill string lowered from the drilling rig through the riser, the lower marine riser package 24, the blowout preventer stack 22, and the wellhead 14 may be used to bore a well. Once drilling of the well is finished, the well can be completed, the blowout preventer stack 22 and the lower marine riser package 24 can be disconnected, and a tree 12 can be mounted on the wellhead 14. The tree 12 can be connected to a manifold 16 by a jumper, as discussed above, to enable fluid communication between the well and the manifold 16 through the tree 12.

The apparatus 10 also includes robotic manipulators 26 coupled to various installed devices described above. More specifically, the apparatus 10 is depicted in FIG. 1 as having robotic manipulators 26 on the trees 12, the manifolds 16, the pumping station 18, the blowout preventer stack 22, and the lower marine riser package 24. These robotic manipulators 26 can be used to carry out various support functions for the installed devices. Several examples of such support functions include actuating valves, installing or retrieving components, inspecting the installed devices, and cleaning the installed devices, though the robotic manipulators 26 may facilitate other support functions. The robotic manipulators 26 can be controlled by human operators, but in some cases the manipulators 26 are provided as autonomous, smart devices programmed to perform various tasks with minimal input from human operators.

Some of the installed devices each include a single robotic manipulator 26, though others (such as the manifolds 16 in FIG. 1) may include multiple robotic manipulators 26. In certain embodiments, a robotic manipulator 26 may include a robotic arm with a design that allows the arm to walk between multiple locations. This walking may be accomplished in any suitable manner, such as by gripping a fixed portion of an installed device with one end of the arm, disconnecting a base of the arm from the device, repositioning the base of the arm to a new location along the device, and reconnecting the base to the device at the new location. The tooling carried by the robotic manipulators 26 may vary depending on the support functions to be performed. In some instances, and as described in greater detail below, a robotic manipulator 26 includes multiple interchangeable tools to facilitate performance of a greater number of support functions for an installed device.

Although shown here as a subsea system, the apparatus 10 could take other forms in different embodiments, such as a topside system, an onshore system, or a system having any combination of subsea, topside, and onshore devices. It will be appreciated that the apparatus 10 can include various devices in addition to or in place of those depicted in FIG. 1, and that some devices noted above may be omitted in certain embodiments. The lower marine riser package 24 can be omitted from onshore embodiments, for instance. Further, the trees 12, the wellheads 14, the manifolds 16, and various other devices of the apparatus 10 could be installed at a fixed location in an oil field or a gas field. For ease of reference, the term "oilfield devices" is used elsewhere herein to generically refer to devices intended for use in an oil field or a gas field. While certain examples of the use of robotic manipulators 26 for performing support functions for subsea devices are described below, it will be appreciated that robotic manipulators 26 can also be used to perform support functions for topside and onshore devices.

Figure 2:
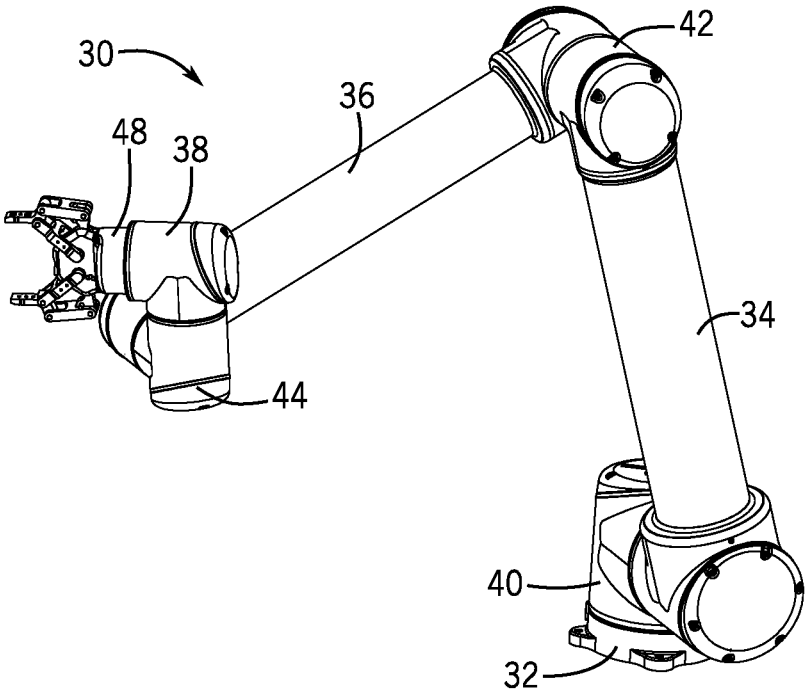
FIGS. 2 and 3 are perspective views of a robotic manipulator in the form of an articulated robotic arm with a gripping tool in accordance with one embodiment.
Figure 3:
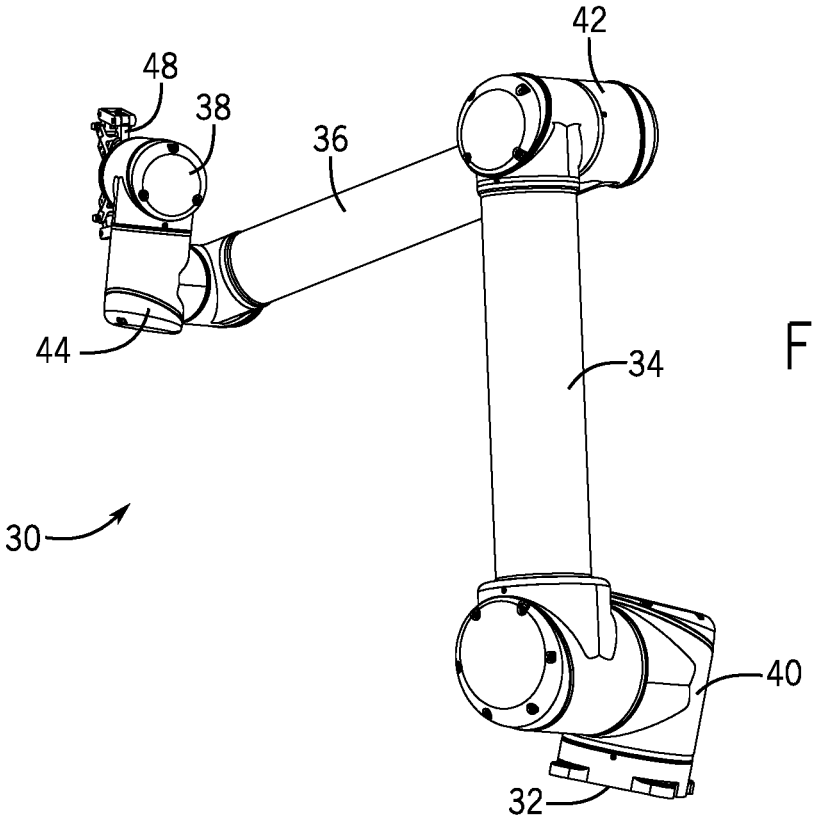

The robotic manipulators 26 can take any suitable form, but in at least some embodiments these robotic manipulators 26 are provided as robotic arms. By way of example, a robotic manipulator 26 may be provided in the form of a robotic arm 30 as depicted in FIGS. 2 and 3. In this embodiment, the robotic arm 30 includes a mounting base 32, arm sections 34 and 36, and a head 38. The arm 30 can be attached to any of numerous different structures, such as various oilfield devices, via the mounting base 32. This allows the arm 30 to act as an onboard remotely operated manipulator for the connected structure.

The depicted robotic arm 30 is an articulated arm with joints that provide rotational degrees of freedom and allow the arm to move and assist in numerous operations, examples of which are described below. As shown in FIGS. 2 and 3, a base joint 40 connects the arm section 34 to the mounting base 32, the arm sections 34 and 36 are connected by an elbow joint 42, and the head 38 is connected to the arm section 36 by a head joint 44. The joints 40, 42, and 44 allow the arm components connected by these joints to pivot with respect to one another. In some cases, for instance, the base joint 40 provides two rotational degrees of freedom between the mounting base 32 and the arm section 34, the elbow joint 42 provides one rotational degree of freedom between the arm sections 34 and 36, and the head joint 44 provides three rotational degrees of freedom between the arm section 36 and the head 38. It is noted, however, that other arrangements in which one or more of the joints provide a different number of rotational degrees of freedom are also envisaged. Movement of the arm 30 can be accomplished with any suitable actuators. Electric motors (e.g., step motors) may be used to control rotation of various arm components in certain embodiments, though other actuators (e.g., hydraulic or pneumatic) could also or instead be used.

The robotic arm 30 includes at least one end effector for interacting with the device to which the robotic arm 30 is to be attached, such as an end effector for manipulating a component of a subsea manifold or of another oilfield device. For example, the robotic arm 30 depicted in FIGS. 2 and 3 includes an end effector in the form of a gripping tool 48 having a pair of jaws for grasping objects. The arm 30 can be moved to position the head 38 near an object and the gripping tool 48 can be used to engage and manipulate the object in a desired manner.

The rotational degrees of freedom of the arm 30 facilitate positioning of the head 38 and the carried tool 48 alongside the manipulated object. More specifically, in at least some embodiments the rotational degrees of freedom of the arm 30 enable the end effector (e.g., the gripping tool 48 or some other tool) to have three translational degrees of freedom with respect to the device to which the arm 30 is attached. This is in contrast to alternatives allowing fewer than three translational degrees of freedom, in which movement of the end effector is more heavily constrained (e.g., two translational degrees of freedom) and in which a device with components to be manipulated is specially configured to accommodate the limited mobility of the end effector.

Figure 4:
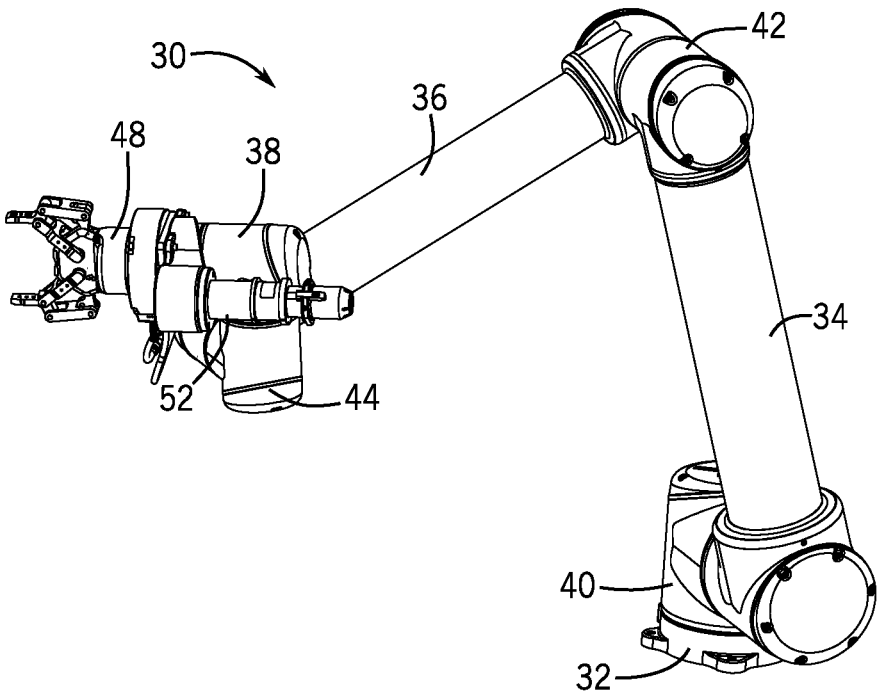
FIGS. 4 and 5 are perspective views of an articulated robotic arm like that of FIGS. 2 and 3, but with both a gripping tool and a torque tool, in accordance with one embodiment.
Figure 5:
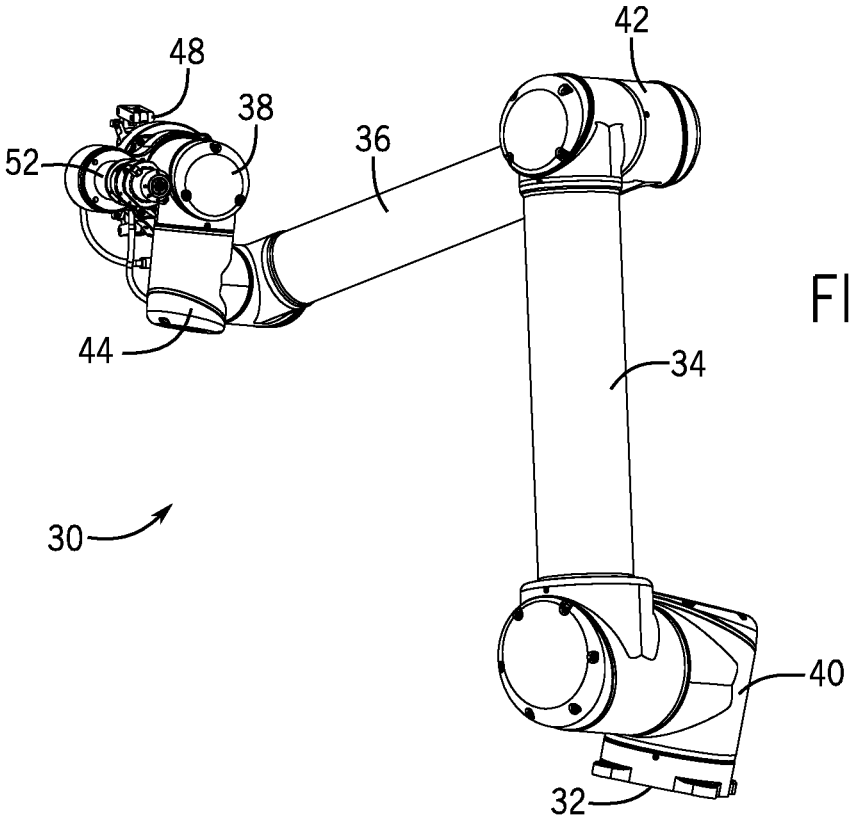

Although shown in FIGS. 2 and 3 with the gripping tool 48, the robotic arm 30 may also or instead carry other tools. For instance, the robotic arm 30 may also include a torque tool 52 on its head 38, as depicted in FIGS. 4 and 5. This torque tool 52 can be used to rotate various components, such as to operate a valve actuator of an oilfield device.

Figure 6:
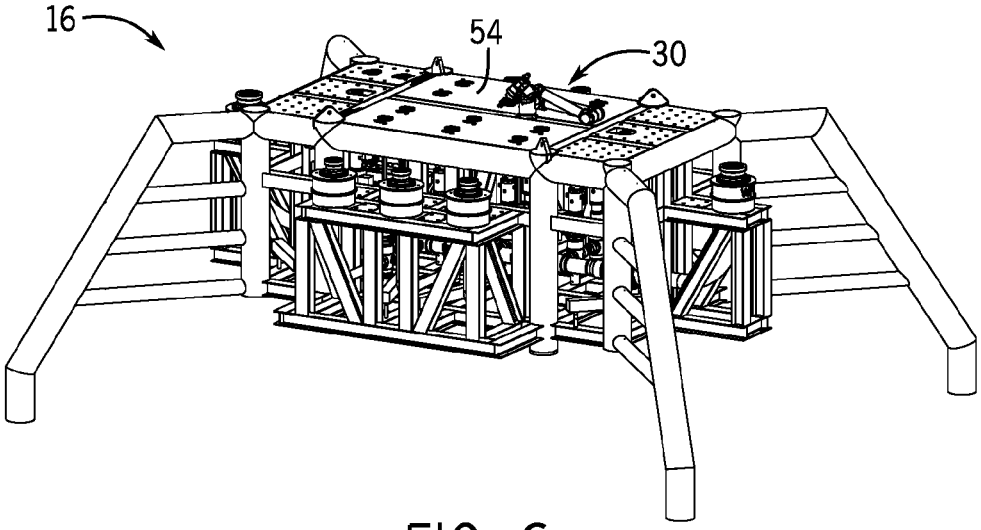
FIG. 6 is a perspective view of a subsea manifold having a robotic arm for facilitating support operations for the subsea manifold in accordance with one embodiment.
Figure 7:
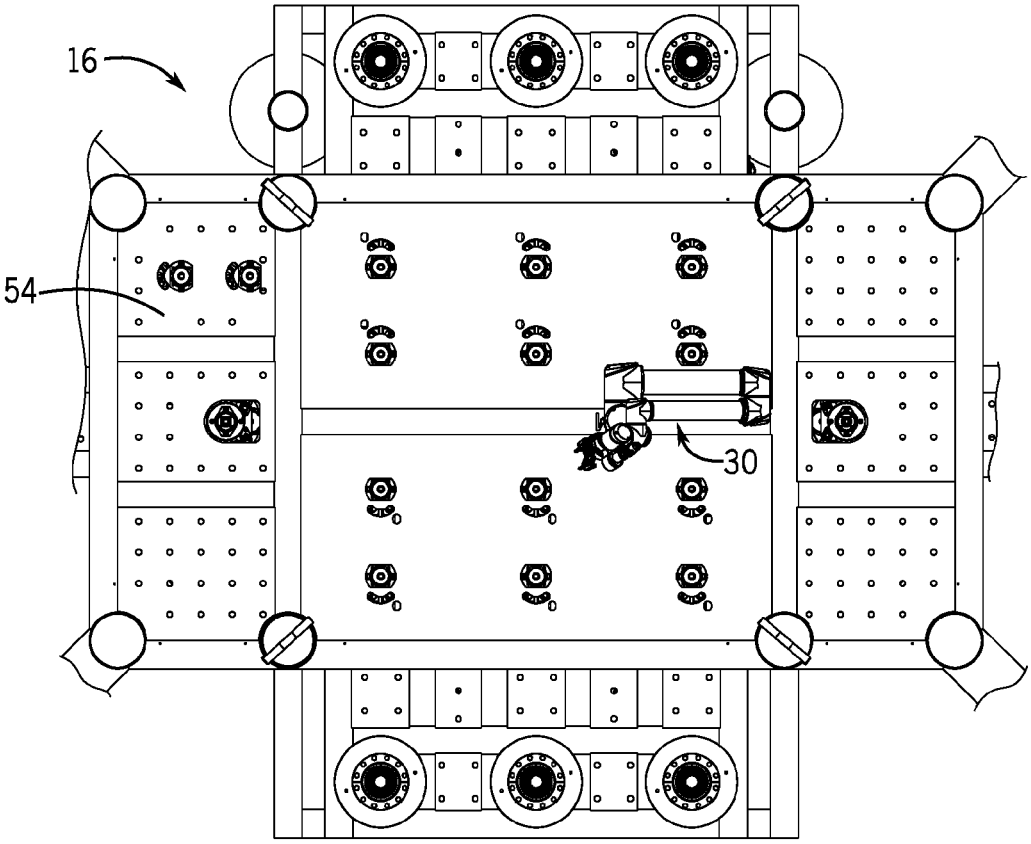
FIG. 7 is a plan view of the subsea manifold and robotic arm of FIG. 6.

Operation of the robotic arm 30 may be better understood with reference to FIGS. 6-9. As depicted in FIGS. 6 and 7, the robotic arm 30 is connected to an upper surface 54 of a subsea manifold 16. In at least one embodiment, the robotic arm 30 is removably coupled to the subsea manifold 16 so as to permit the robotic arm 30 to be disconnected and separately retrieved from the manifold 16 while the manifold 16 is installed on a seabed. The robotic arm 30 may also be operated to assist in its own installation and retrieval in some cases.

Figure 8:
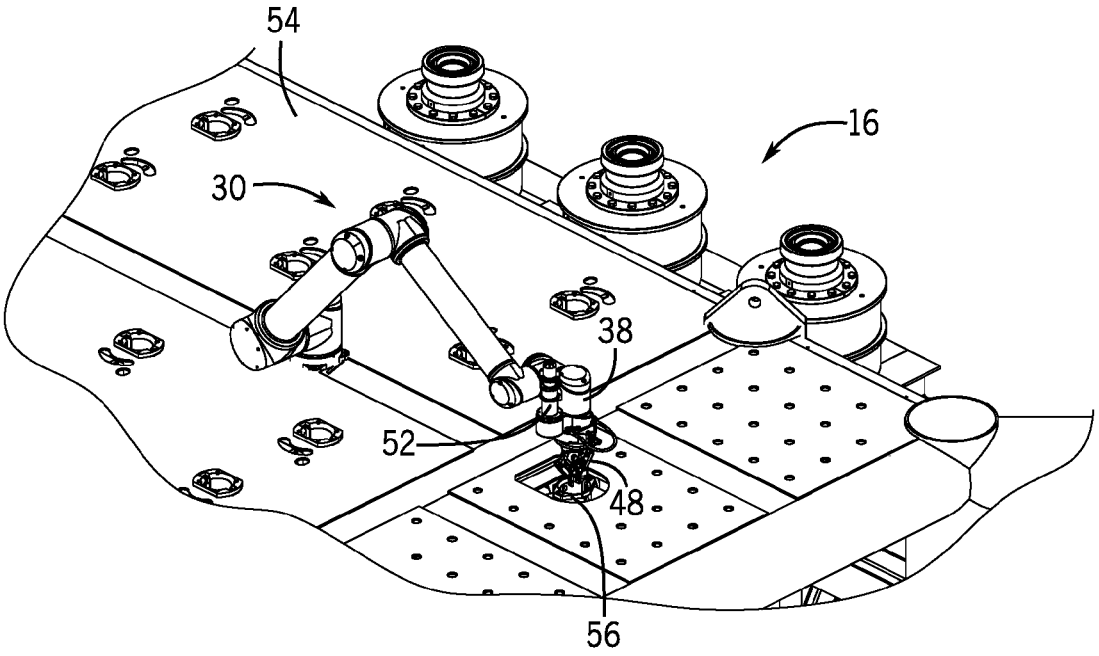
FIG. 8 depicts the robotic arm of FIGS. 6 and 7 in an extended position during a support operation, with a gripping tool of the arm facing the subsea manifold, in accordance with one embodiment.
Figure 9:
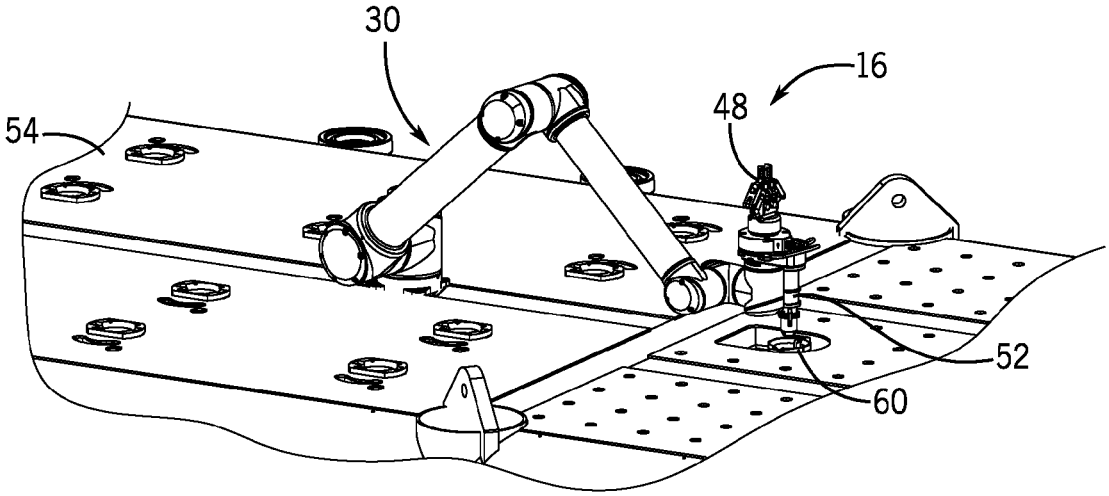
FIG. 9 depicts the robotic arm of FIG. 8 with a torque tool of the arm facing the subsea manifold during a support operation in accordance with one embodiment.

The robotic arm 30 can be moved to facilitate various support functions, as noted elsewhere herein. For example, other devices (e.g., trees 12, another manifold 16, and the pumping station 18) can be connected in fluid communication with the manifold 16, and the robotic arm 30 can be used to actuate valves of the manifold 16 to control fluid flow. In one such instance, the robotic arm 30 is moved from the resting position shown in FIGS. 6 and 7 toward an extended position in which the head 38 of the arm 30 is positioned near a valve actuator 60, as generally shown in FIGS. 8 and 9. In this extended position, the arm 30 can be lowered or raised to move an end effector toward or away from the actuator 60 (or any other component that is to be manipulated with the robotic arm 30). In conjunction with this movement of the arm 30, the gripping tool 48 can be used to grasp and remove a debris cover 56 from the subsea manifold 16 to expose the valve actuator 60, and the torque tool 52 can be used to control a valve by applying torque to the exposed actuator 60. Once manipulation of the valve actuator 60 is complete, the debris cover 56 can be returned to its place over the valve actuator 60.

The robotic arm 30 is depicted in FIGS. 6-9 as having both the gripping tool 48 and the torque tool 52. In this arrangement, the head 38 of the arm 30 can be rotated to generally alternate the positions of these tools with little movement of the rest of the arm 30. But in other embodiments the robotic arm 30 may carry just a single tool at any given time. In some cases, multiple robotic arms 30 can be used to facilitate support operations, such as one robotic arm 30 with a gripping tool 48 and another robotic arm with a torque tool 52.

In still other cases, a robotic arm 30 may be used with multiple, interchangeable end effectors (e.g., gripping tool 48, torque tool 52, and other tools) designed to perform different functions. These interchangeable end effectors may include any of a multitude of different tools that can be connected to and disconnected from the robotic arm 30 on an as-needed basis. When not in use, the interchangeable end effectors in at least some embodiments are positioned within reach of the robotic arm 30 to facilitate retooling of the arm 30 with different end effectors. The number and types of different, interchangeable end effectors can be selected by a user based on the support functions expected to be carried out by the robotic arm 30.

Figure 10:
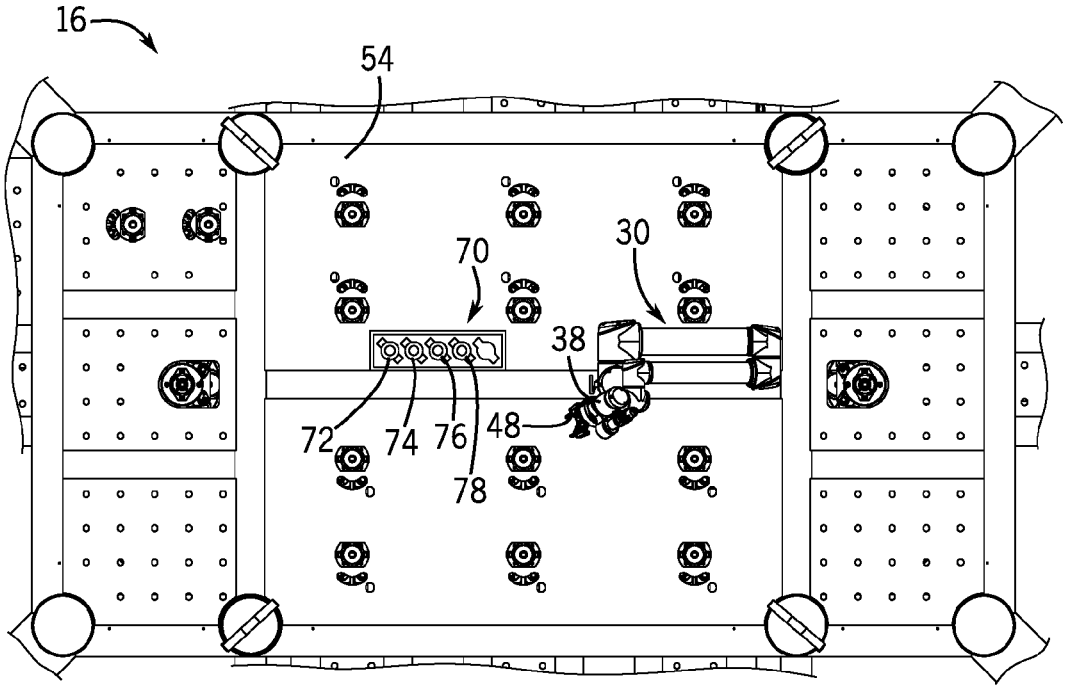
FIG. 10 depicts the subsea manifold of FIGS. 6 and 7 as having a tool box holding multiple, interchangeable tools that can be installed on the robotic arm in accordance with one embodiment.
Figure 11:
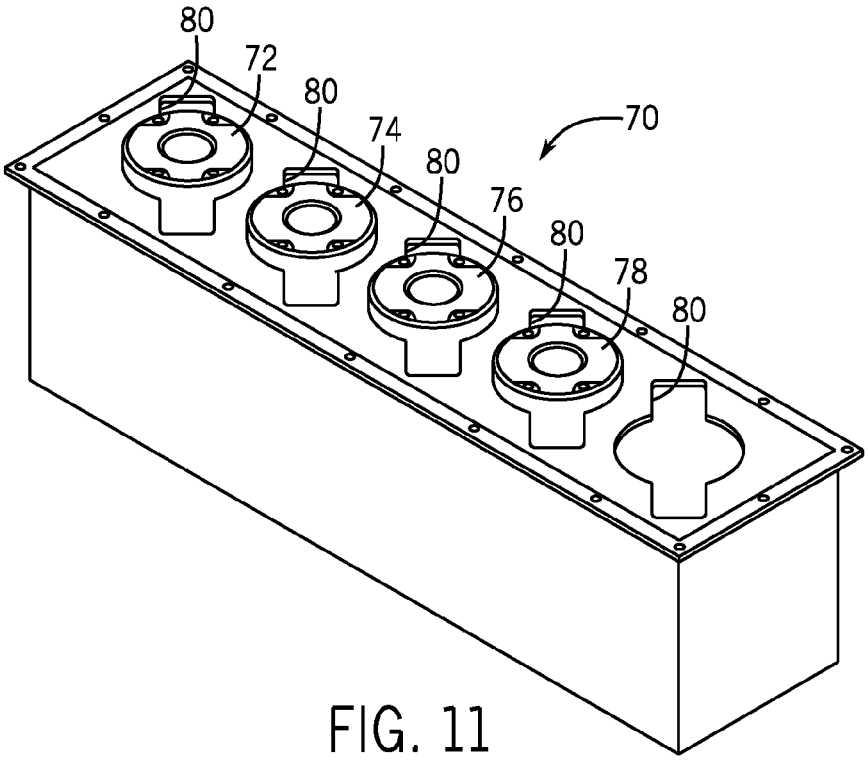
FIG. 11 is a perspective view of the tool box of FIG. 10, shown isolated from the subsea manifold, in accordance with one embodiment.

The interchangeable end effectors are held by a tool box in at least some embodiments. As one example, a tool box 70 is shown in FIG. 10 as coupled to the upper surface 54 of the manifold 16 near the robotic arm 30. The depicted tool box 70 holds additional end effectors in the form of tools 72, 74, 76, and 78. These additional tools 72, 74, 76, and 78 can include any of a variety of tools that facilitate desired support operations, such as gripping tools, torque tools, and spraying tools (e.g., water jet tools for cleaning) to name just a few examples. As best shown in FIG. 11, the tool box 70 includes individual slots 80 for holding the assortment of tools.

Figure 12:
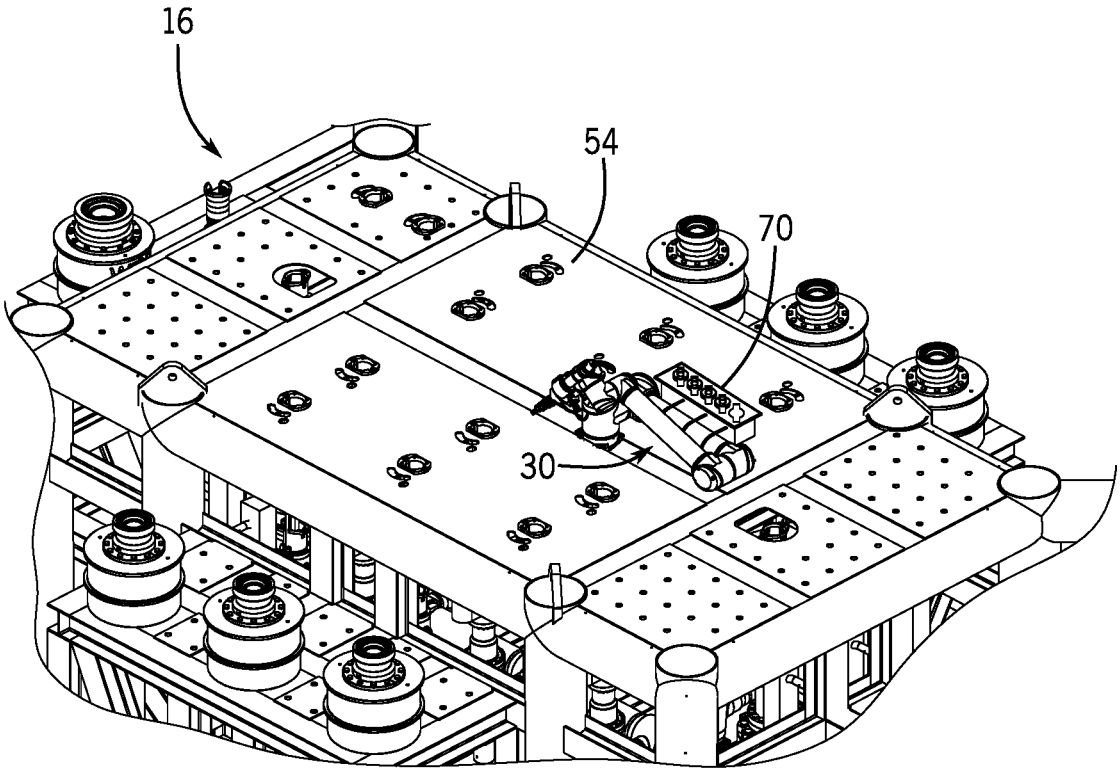
FIG. 12 is a perspective view of the subsea manifold of FIGS. 6 and 7 as having the tool box of FIG. 11 mounted on the robotic arm in accordance with one embodiment.

A tool (e.g., the gripping tool 48) carried by the robotic arm 30 can be disconnected from the robotic arm 30 and replaced with a different tool, such as one of the tools 72, 74, 76, and 78. In one automated retooling process, for example, the robotic arm 30 carrying a first tool is moved to insert the first tool into the empty slot 80 of the tool box 70 and the robotic arm 30 is disconnected from the first tool to leave that tool in its slot 80. The arm 30 is then moved away from the first tool and into engagement with a second tool in the tool box 70 to enable the second tool to be carried in place of the first tool by the arm 30. In this manner, the robotic arm 30 can fit itself with different tools appropriate for performing an array of desired support operations. It is noted, however, that in some other embodiments (e.g., in topside or onshore implementations) the tools can be interchanged manually by an operator. The tool box 70 can be positioned at any suitable location near the robotic arm 30. In some instances, this can include mounting the tool box 70 on a portion of the robotic arm 30, such as generally depicted in FIG. 12.

Figure 13:
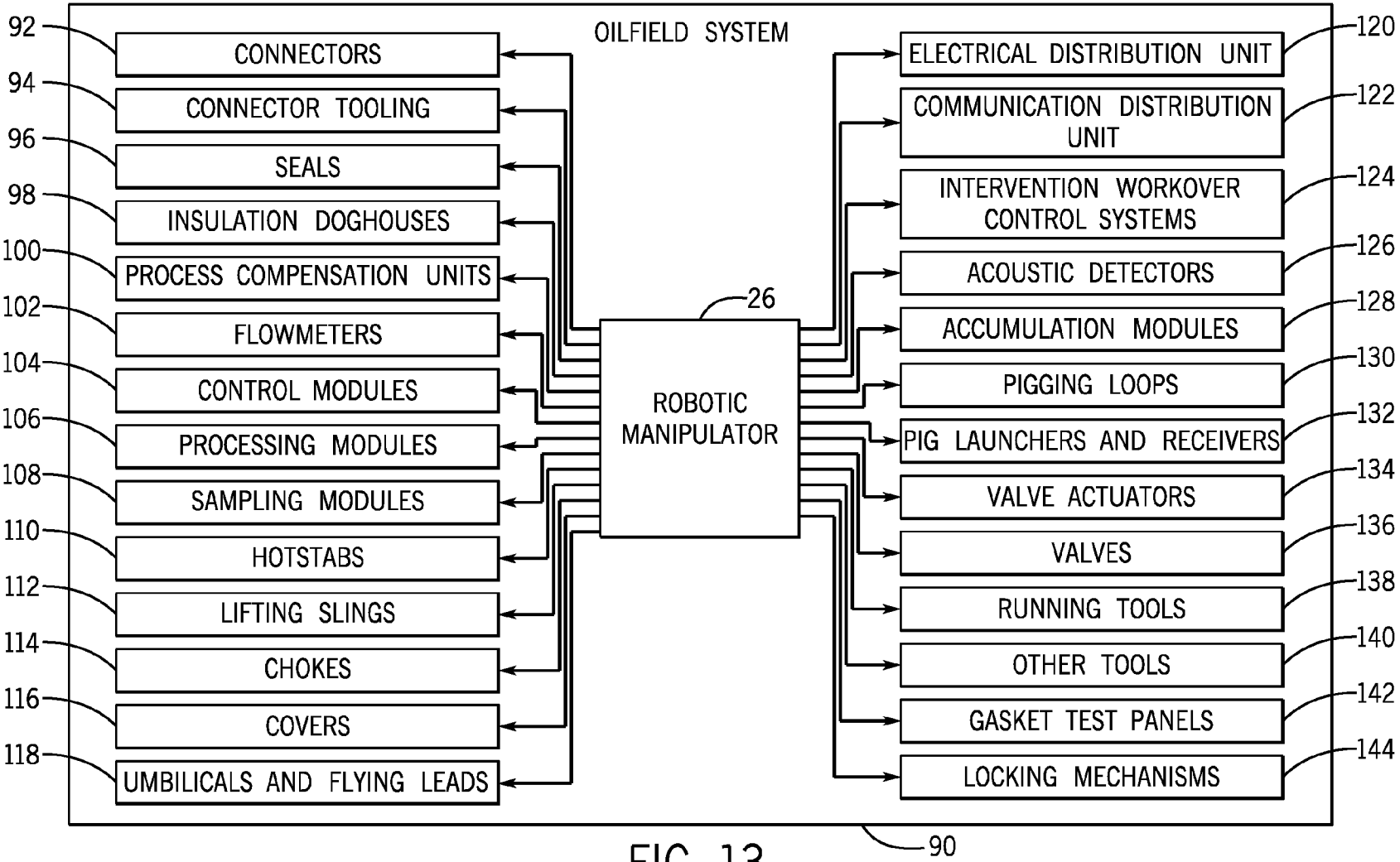
FIG. 13 generally depicts various components with which a robotic manipulator may interact to perform support operations in accordance with one embodiment.

While certain examples of support tasks that can be performed with robotic manipulators 26 (e.g., the robotic arm 30) are described above, it is again noted that such robotic manipulators 26 can have many capabilities and can be used to enable a wide array of support functions. This versatility is generally represented in FIG. 13, in which an oilfield system 90 is shown to include a robotic manipulator 26 capable of interacting with numerous components. The system 90 can include one or more oilfield devices, which may be located subsea, topside, or onshore. The components depicted in FIG. 13 are representative of components of such oilfield devices, and it will be appreciated that the oilfield devices can include any combination of these or other components with which the robotic manipulator 26 may interact.

More particularly, the robotic manipulator 26 can be used to facilitate installation or retrieval of many different components from a given installed device (e.g., a tree 12, a manifold 16, a pump 18, or a blowout preventer stack 22). For example, the robotic manipulator 26 can be used for installing or retrieving (or otherwise manipulating) the following: various connectors 92, which may include clamps; connector tooling 94; various seals 96, such as hub seals; insulation doghouses 98; process compensation units 100; flowmeters 102; control modules 104; processing modules 106; sampling modules 108; hotstabs 110; lifting slings 112 (including, in one embodiment, manipulating shackles of a lifting sling); chokes 114; covers 116, such as debris covers; umbilicals and flying leads 118, such as electrical flying leads (EFLs), hydraulic flying leads (HFLs), steel flying leads (SFLs), umbilical termination heads (UTHs), optical flying leads (OFLs), and associated equipment; electrical distribution units 120; communication distribution units 122; intervention workover control systems (IWOCs) 124; acoustic detectors 126; accumulation modules 128; pigging loops 130; pig launchers and receivers 132; and valve actuators 134. The robotic manipulator can also be used to operate valves 136 (e.g., mechanical operation of all override types), running tools 138 (for connection systems, control modules, etc.), other tools 140 (e.g., replacement and cleaning tools for connection systems), gasket test panels 142, and locking mechanisms 144. Still further, the robotic arm 30 or some other robotic manipulator 26 can perform on-demand inspection services (e.g., verifying valve indicators and bullseye inspection), cleaning (e.g., of the installed device and associated components), and cathodic protection point monitoring.

Several representative examples of such support operations are described in greater detail below for explanatory purposes. First, a robotic manipulator 26 (such as the robotic arm 30) can be used for valve intervention. As generally described above, the robotic manipulator 26 can be used to remove a debris cover, operate the valve (e.g., to open or shut the valve), and then replace the debris cover. The manipulated valves (e.g., valves 136) can be of any size, class, and override type (e.g., rotary, linear, or paddle type).

The robotic manipulator 26 can also be used for connection system intervention. In some instances, this may include using the robotic manipulator 26 to facilitate make up or disconnection of connectors 92, such as by aligning a jumper and a running tool 138, operating the running tool 138, and installing and retrieving associated caps (e.g., covers 116). In other cases, the robotic manipulator 26 facilitates make up or disconnection of connectors 92 by aligning a jumper, operating a pull-in cylinder to set or break a connection, and installing or retrieving associated caps.

In another embodiment, the robotic manipulator 26 may be used to facilitate pigging operations. For instance, the robotic manipulator 26 can align and install a pigging loop 130 (e.g., on a subsea manifold) with running tools 138, operate an isolation valve 136, operate a gasket test panel 142, and operate running tools 138 for retrieval of the pigging loop 130 after a pigging operation is completed. The robotic manipulator 26 can also be used to align and install a pig launcher and receiver 132, operate an associated connection system, and operate the gasket test panel 142.

The robotic manipulator 26 can also be used to install or retrieve flowmeters 102, chokes 114, or various modules, such as control modules 104, processing modules 106, sampling modules 108, communication distribution units 122, and accumulation modules 128. Such support operations using the manipulator 26 may include removing a dropped object cover, aligning the module (or flowmeter) with an oilfield device, moving the module into engagement with the oilfield device, replacing the dropped object cover, and connecting one or more leads 118 (e.g., EFLs or OFLs) between the installed module and other components of the oilfield device. The robotic manipulator 26 can also be used to remove the dropped object cover, uninstall the one or more leads 118, remove the module from the oilfield device, and replace the dropped object cover. In some cases, locking mechanisms 144 or other components may also be manipulated via the robotic manipulator 26 to facilitate installation or retrieval of a flowmeter, module, or other given component.

Figure 14:
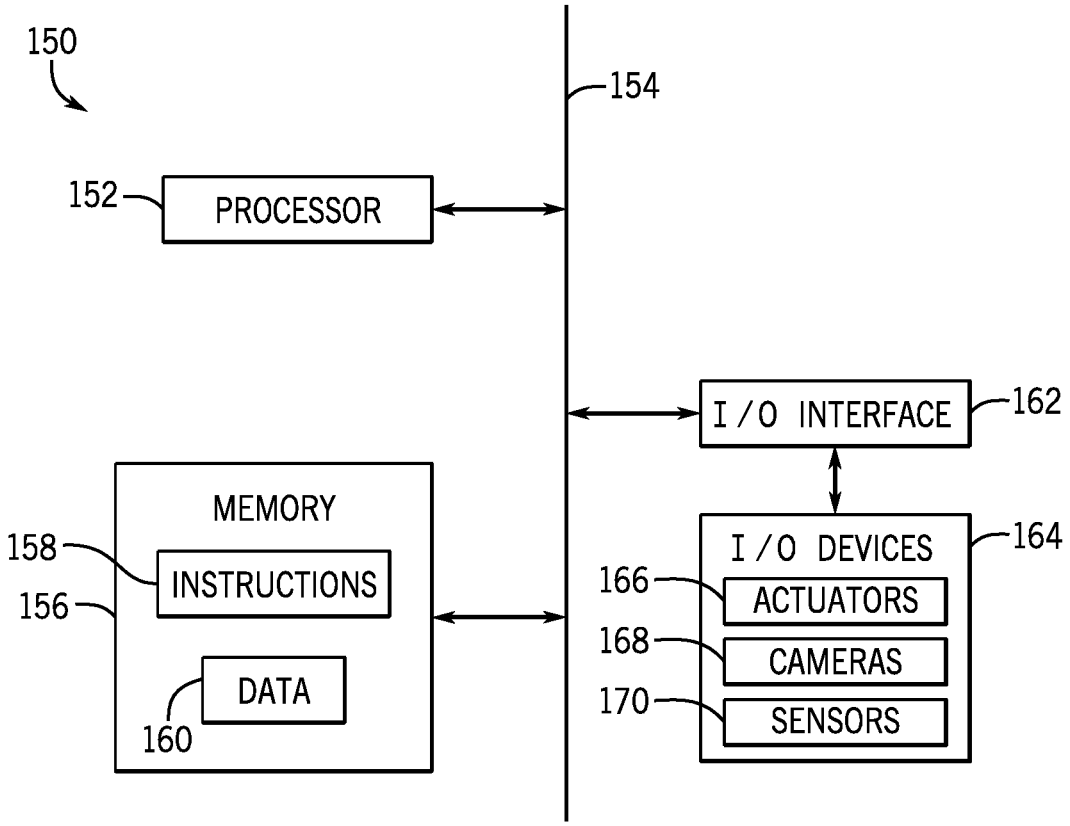
FIG. 14 is a block diagram of a control system of a robotic manipulator in accordance with one embodiment.

Certain additional features of a robotic manipulator 26 (e.g., a robotic arm 30) are generally depicted in FIG. 14 in accordance with one embodiment. Particularly, the robotic manipulator 26 may be operated via a processor-based control system, an example of which is provided in FIG. 14 and generally denoted by reference numeral 150. In this depicted embodiment, the system 150 includes a processor 152 connected by a bus 154 to a memory device 156. It will be appreciated that the system 150 could also include multiple processors or memory devices, and that such memory devices can include volatile memory (e.g., random-access memory) or non-volatile memory (e.g., flash memory and a read-only memory). The one or more memory devices 156 are encoded with application instructions 158 (e.g., software executable by the processor 152 to perform various functionality described above), as well as with data 160 (e.g., positions of, and other information about, components with which the robotic manipulator may interact). In one embodiment, the application instructions 158 are stored in a read-only memory and the data 160 is stored in a writeable non-volatile memory (e.g., a flash memory).

The system 150 also includes an interface 162 that enables communication between the processor 152 and various input or output devices 164. The interface 162 can include any suitable device that enables such communication, such as a modem or a serial port. The input and output devices 164 can include any number of suitable devices. For example, in one embodiment the devices 164 include actuators 166 (e.g., step motors) for moving the robotic manipulator in a desired manner, cameras 168, and sensors 170. For instance, the robotic arm 30 can be fitted with one or more cameras 168 to facilitate operation of the arm 30 and on-demand visual inspection of nearby devices and components (e.g., a subsea oilfield device and associated components). The robotic manipulator 26 can include any desired sensors 170 and, in at least some embodiments, the sensors 170 include location or proximity sensors that may be used by the control system 150 for collision avoidance (i.e., to avoid unintentional collision of the robotic manipulator with some other object). Power and data may also be communicated between the robotic manipulator 26 and the structure to which it is attached, such as an oilfield device. For instance, electrical power, data, and operating commands may be provided to the robotic manipulator 26 from the structure (e.g., through the mounting base 32 of the robotic arm 30). Additionally, data may be communicated from the robotic manipulator 26 to the structure, from which it may be communicated to some other location, such as a topside or surface monitoring station. The actuators 166, cameras 168, and sensors 170 can be provided as part of the robotic manipulator 26, though other devices 164 (e.g., human-machine interfaces) may be separate from the robotic manipulator 26.

Use of the robotic manipulators 26 described above may allow a reduction in the use of small working class vessels in the field by providing on-demand inspection capabilities, by operating valves and other mechanisms on the installed devices, by facilitating installation and retrieval of most retrievable components, and by allowing cleaning of the installed devices by the robotic manipulators 26. Further, the robotic manipulators 26 may also enable a reduction in overall weight of the installed devices, an increase in productivity (e.g., by allowing the onboard robotic manipulator to perform certain operations on demand, rather than waiting for intervention from an ROV), and a reduction in downtime of offshore installations and intervention campaigns. Although described above in connection with oilfield devices, it will be appreciated that the robotic manipulators 26 may be used with other, non-oilfield devices in full accordance with the present technique.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An apparatus comprising:

an oilfield device configured to be installed at a fixed location as part of a subsea production system;

a robotic manipulator fixedly mounted on the oilfield device, the robotic manipulator having a tool for interacting with components of the oilfield device, wherein the robotic manipulator provides three translational degrees of freedom of the tool with respect to the oilfield device, the tool is a removable tool configured to be detached from the robotic manipulator, and the tool is one of a plurality of interchangeable tools configured to be installed on the robotic manipulator; and a tool box for holding multiple tools of the plurality of interchangeable tools, wherein the tool box is mounted at a location accessible by the robotic manipulator so as to facilitate interchanging of the tool on the robotic manipulator with one of the multiple tools that is held by the tool box, the tool box includes individual slots for holding the multiple tools of the plurality of interchangeable tools, and the individual slots include an empty individual slot for receiving the tool on the robotic manipulator to facilitate interchanging of the tool on the robotic manipulator with one of the multiple tools that is held by the tool box.

2. The apparatus of claim 1, wherein the robotic manipulator includes an articulated arm mounted on the oilfield device.

3. The apparatus of claim 2, wherein the articulated arm includes a proximal end mounted on the oilfield device and a distal end having the tool.

4. The apparatus of claim 1, wherein the tool box is provided on the robotic manipulator.

5. The apparatus of claim 1, wherein the tool box is provided on the oilfield device.

6. The apparatus of claim 1, wherein the tool includes a gripping tool or a torque tool.

7. The apparatus of claim 1, wherein the oilfield device includes a subsea manifold, a tree, a blowout preventer, or a pump.

8. An apparatus comprising:

a subsea manifold configured to be installed as part of a subsea production system; and a robotic arm fixedly mounted on the subsea manifold, wherein the robotic arm includes an articulated arm having a head with one or more tools for interacting with components of the subsea manifold, wherein the robotic arm is coupled to the subsea manifold via a mounting base of the robotic arm that enables electrical power and data to be provided to the robotic arm from the subsea manifold through the mounting base.

9. The apparatus of claim 8, wherein the robotic arm is a retrievable arm that can be disconnected and separately retrieved from the subsea manifold while the subsea manifold is installed on a seabed.

10. The apparatus of claim 8, wherein the robotic arm includes a camera that enables visual inspection of the subsea manifold via the robotic arm.

11. A method comprising:

moving a robotic arm that includes a tool and is fixedly mounted on an installed oilfield device of a subsea production system so as to move the tool with respect to the installed oilfield device; and operating the robotic arm to perform a support operation for the installed oilfield device;

wherein operating the robotic arm to perform a support operation for the installed oilfield device includes operating the robotic arm to actuate a valve of the installed oilfield device, moving the robotic arm so as to move the tool with respect to the installed oilfield device includes moving the robotic arm to position the tool alongside an actuator of the valve, and operating the robotic arm to actuate the valve of the installed oilfield device includes operating the tool to actuate the valve via the actuator;

the method further comprising:

using the robotic arm to remove a debris cover, with an additional tool of the robotic arm, from the installed oilfield device to expose the actuator of the valve; and using the robotic arm to replace the debris cover, with the additional tool of the robotic arm, following actuation of the valve by the robotic arm.

12. The method of claim 11, wherein operating the robotic arm to perform a support operation for the installed oilfield device includes operating the robotic arm to facilitate installation of a component in the installed oilfield device or retrieval of the component from the installed oilfield device.

13. The method of claim 12, wherein operating the robotic arm to facilitate installation or retrieval of the component includes operating the robotic arm to align the component with the installed oilfield device, to move the component into engagement with the installed oilfield device, and to connect one or more leads between the component and the installed oilfield device.

14. The method of claim 11, comprising disconnecting the tool from the robotic arm and replacing the tool with the additional tool.

15. The method of claim 14, wherein disconnecting the tool from the robotic arm and replacing the tool with the additional tool includes:

moving the robotic arm so as to insert the tool into a tool box having the additional tool;

disconnecting the tool from the robotic arm while the tool is received in the tool box; and moving the robotic arm away from the tool and into engagement with the additional tool so as to receive the additional tool on the robotic arm in place of the tool disconnected from the robotic arm and received in the tool box.

16. An apparatus comprising:

a subsea production system including oilfield devices installed along a seabed, the oilfield devices including:

a plurality of trees coupled to subsea wellheads;

a subsea manifold connected in fluid communication with the plurality of trees, the subsea manifold including valves to control flow of produced hydrocarbons or other fluids from the plurality of trees through the subsea manifold; and a pumping station connected in fluid communication with the subsea manifold;

wherein the subsea production system also includes a robotic arm fixedly mounted on the subsea manifold, the robotic arm includes an articulated arm having a head with a tool for actuating the valves of the subsea manifold to control flow of the produced hydrocarbons or the other fluids from the plurality of trees through the subsea manifold, the robotic arm is coupled to the subsea manifold via a mounting base of the robotic arm that enables electrical power and data to be provided to the robotic arm from the subsea manifold through the mounting base, the tool is one of a plurality of interchangeable tools, and an additional tool of the plurality of interchangeable tools is held by a tool box mounted at a location accessible by the robotic arm so as to facilitate interchanging of the tool and the additional tool on the robotic arm.

17. The apparatus of claim 16, wherein an additional robotic arm is installed on the pumping station or on a tree of the plurality of trees to enable the additional robotic arm to perform support operations for the pumping station or the tree.

* * * * *